US007684733B2

(12) United States Patent
Fukunaga

(10) Patent No.: US 7,684,733 B2
(45) Date of Patent: Mar. 23, 2010

(54) ELECTROPHOTOGRAPHIC PHOTOSENSITIVE MEMBER ROTATABLY SUPPORTED IN AN IMAGE FORMING APPARATUS

(75) Inventor: Hideaki Fukunaga, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 321 days.

(21) Appl. No.: 11/692,779

(22) Filed: Mar. 28, 2007

(65) Prior Publication Data

US 2007/0231005 A1 Oct. 4, 2007

(30) Foreign Application Priority Data

Mar. 30, 2006 (JP) ..... 2006-096024
Feb. 28, 2007 (JP) ..... 2007-049847

(51) Int. Cl.
*G03G 15/00* (2006.01)
*G03G 15/02* (2006.01)
*G03G 21/00* (2006.01)

(52) U.S. Cl. ..... 399/159; 399/176; 399/350; 430/56; 430/66

(58) Field of Classification Search ..... 399/159, 399/174, 176, 350; 430/56, 66
See application file for complete search history.

(56) References Cited

U.S. PATENT DOCUMENTS 5,983,055 A * 11/1999 Bito et al. ..... 399/159
6,226,479 B1 5/2001 Karaki et al. ..... 399/159

FOREIGN PATENT DOCUMENTS

JP 57-115551 7/1982
JP 59-213439 12/1984
JP 61025153 A 2/1986
JP 61-295375 12/1986
JP 62-258466 11/1987
JP 02-029662 1/1990
JP 02-132449 5/1990
JP 04073768 A 3/1992
JP 06317920 A 11/1994
JP 11133643 A 5/1999
JP 11133644 A 5/1999
JP 11-343573 12/1999
JP 11344911 A 12/1999
JP 2000-098642 4/2000
JP 2005309211 A 11/2005

OTHER PUBLICATIONS

Notice for Reason for Refusal (2007-049847) with English translation.
Notice for Reason for Refusal (2008-198968) with English translation.
Japanese language office action and its English language translation for corresponding Japanese application 2007049847 lists the references above.

* cited by examiner

*Primary Examiner*—William J Royer
(74) *Attorney, Agent, or Firm*—Hogan & Hartson LLP

(57) ABSTRACT

An electrophotographic photosensitive member rotatably supported in an image forming apparatus. The electrophotographic photosensitive member includes a substantially cylindrical body and a photosensitive layer formed thereon and having a latent image forming area. The photosensitive layer is, when incorporated in the image forming apparatus, pressed harder at a middle portion than at end portions in an axial direction of the latent image forming area, and a thickness at the middle portion is larger than at the end portions. The photosensitive layer may have a dynamic indentation hardness larger at the middle portion than at the end portions.

21 Claims, 6 Drawing Sheets

ELECTROPHOTOGRAPHIC PHOTOSENSITIVE MEMBER ROTATABLY SUPPORTED IN AN IMAGE FORMING APPARATUS

CROSS-REFERENCE TO RELATED APPLICATIONS

The present application claims priority under 35 U.SC. 119 to Japanese Patent Application No. 2006-096024, filed Mar. 30, 2006 and No. 2007-049847, filed Feb. 28, 2007 entitled "ELECTROPHOTOGFAPHIC PHOTOSENSITIVE MEMBER, AND IMAGE FORMING APPARATUS USING SAME." The contents of these applications are incorporated herein by reference in their entirety.

BACKGROUND OF THE INVENTION

1. Field of the Invention

The present invention relates to an electrophotographic photosensitive member and an image forming apparatus provided with the same.

2. Description of the Related Art

An image forming apparatus such as a copying machine and a printer utilizing an electrophotographic method is provided with an electrophotographic photosensitive member for forming electrostatic latent images and toner images. The electrophotographic photosensitive member is required to have an electrophotographic property (i.e. potential characteristic such as a charging characteristic, an optical sensitivity and a residual potential, and an image characteristic such as image density, image resolution, image contrast and image tone) of high quality and stability, as well as durability (against friction, wear, environment and chemical). In order to obtain them, an electrophotographic photosensitive member is suggested to have a conductive body formed with a photosensitive layer including a photoconductive layer and a surface layer.

For the surface layer, various materials and structures have been suggested. An example of the materials includes amorphous silicon materials. Among the amorphous silicon materials, amorphous silicon carbide (a-SiC) containing carbon (C) especially attracts attention as the material of the surface layer that has e.g. high electrical property, high luminous sensitivity, high image property, and high endurance based on high hardness. Further, an electrophotographic photosensitive member provided with a combination of a surface layer made of a-SiC and a photoconductive layer made of amorphous silicon (a-Si) has already been in practical use.

In the photosensitive member containing amorphous silicon, variation in the thickness of the photosensitive layer in the axial direction causes variation in density in the axial direction. Thus, the thickness of the photosensitive layer in the axial direction has been suggested to be substantially constant (i.e. a ratio of the thickness at the end portions to the thickness at the middle portion in the axial direction is not more than ±2%).

JP-A-11-343573 discloses a deposited film forming apparatus provided with a plurality of exhaust holes at an area of a cylindrical adhesion preventing member arranged to surround a cylindrical supporting body and material gas inlet tubes. According to the deposited film forming apparatus, by adjusting the arrangement of the exhaust holes, variation in film thickness of the deposited film in the axial direction of the body can be reduced without complicating the structure of the apparatus and the deposited film forming process.

JP-A-59-213439 discloses a technique for preventing variation in the thickness of the photosensitive layer by providing gas inlet/outlet holes at walls of cylindrical electrodes so that the electrodes serve as gas inlet/outlet member for discharging material gas uniformly into a discharging area.

JP-A-58-30125 discloses a technique for making an electrophotographic photosensitive member without variation in film thickness. The photosensitive member is provided with, separately from a cylindrical electrode, a gas inlet tube for introducing material gas. The gas inlet tube is provided with gas outlet holes whose dimension and arrangement are changed longitudinally of a cylindrical plate, so that material gas is discharged uniformly.

Regarding the surface layer made of a-SIC, the thickness and C content of the surface layer is also studied (see JP-B-01-10069 and JP-A-62-258466, for example).

JP-B-01-10069 discloses a photosensitive member including a surface layer with a thickness of 30 Å-5 μm and carbon content of 40-90 atom %.

JP-A-62-258466 provides a photoreceptive member including a surface layer containing carbon atom with Si atom as the matrix, and concentration of the carbon atom increases as proceeding from a boundary surface with the photosensitive layer to a free surface. In the surface layer of the photoreceptive member, the carbon atom is dispersed at a concentration of 0.5-95 atom %, and thickness of the surface layer is preferably 0.003-30 μm.

However, with the electrophotographic photosensitive member disclosed in the above patent documents, even having a surface layer made of a-SiC, when incorporated in an image forming apparatus utilizing an electrophotographic method and undergoing printing processes, defective images with e.g. flaws and variation in density (resulting in faint images or fogged images) are caused. One of the reasons of such defective images is that the surface layer is ground. For example, toner contains abrasive for grinding a polar surface on the surface layer for preventing the surface layer from adsorbing discharge products generated in corona discharge. Thus, the surface layer is more likely to be ground at the middle portion where images are often printed than at other portions such as the end portions, thereby causing flaws in images.

Therefore, techniques for preventing such flaws in images by changing composition to increase hardness of the surface layer or by increasing the thickness of the surface layer have been suggested and already been in practical use. However, when hardening the surface layer or increasing the thickness, various problems are caused: deterioration in charging ability or increase in residual potential in the photosensitive member; attachment of toner to the surface of the photosensitive member (resulting in a gap between the member and a blade); image deletion; and increase in manufacturing time (film forming time) of the photosensitive member.

SUMMARY OF THE INVENTION

An object of the present invention is to provide an electrophotographic photosensitive member and an image forming apparatus provided with the same. The electrophotographic photosensitive member reliably stands for long use and prevents flaws and image degradation even after undergoing printing processes.

The present invention relates to an electrophotographic photosensitive member rotatably supported in an image forming apparatus. The electrophotographic photosensitive member comprises a substantially cylindrical body and a photosensitive layer formed thereon and having a latent image forming area. The present invention further relates to an image forming apparatus comprising an electrophotographic photosensitive member including a substantially cylindrical body which is rotatably supported, and a photosensitive layer formed thereon and having a latent image forming area, and also comprising a pressing member pressing the body harder at a middle portion than at end portions in an axial direction of the latent image forming area. The photosensitive layer is, when incorporated in the image forming apparatus, pressed harder at the middle portion than at the end portions in the axial direction of the latent image forming area, and the thickness at the middle portion is larger than at the end portions. The photosensitive layer may have a dynamic indentation hardness larger at the middle portion than at the end portions.

DETAILED DESCRIPTION OF THE PREFERRED EMBODIMENTS

An image forming apparatus and an electrophotographic photosensitive member according to the present invention are specifically described below with reference to the accompanying drawings.

Figure 1:
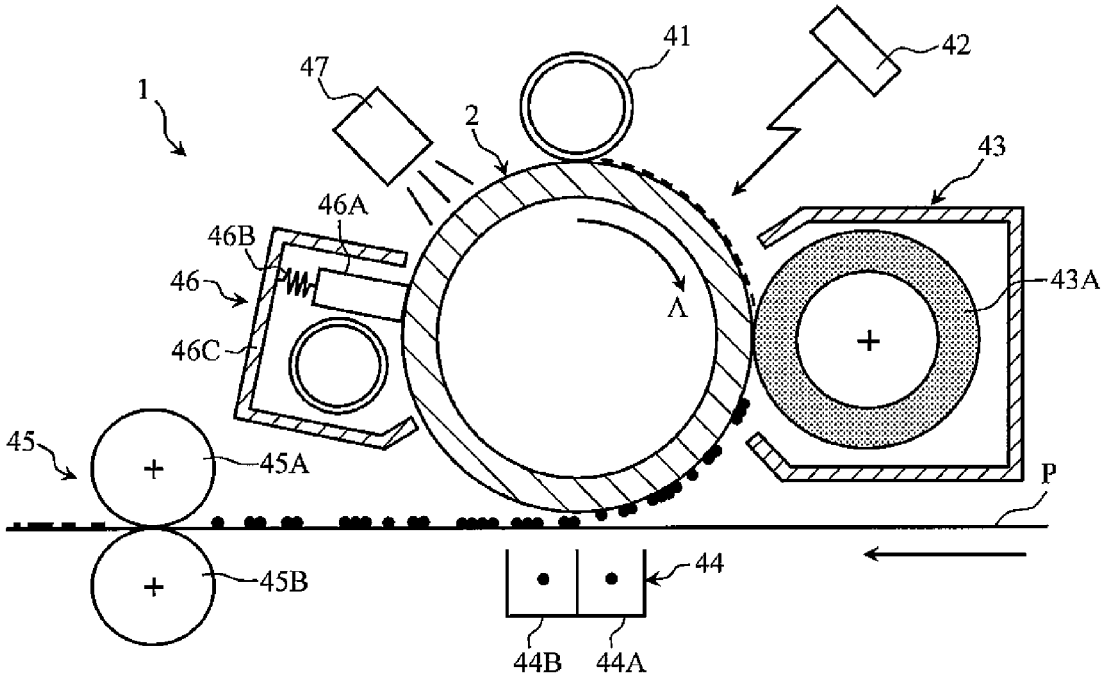
FIG. 1 is a schematic view illustrating an example of an image forming apparatus according to the present invention.

An image forming apparatus 1 shown in FIGS. 1 and 2 utilizes the Carlson method for image forming, and includes an electrophotographic photosensitive member 2, a rotation mechanism, an electrification mechanism 41, an exposure mechanism 42, a development mechanism 43, a transfer mechanism 44, a fixing mechanism 45, a cleaning mechanism 46, and a discharging mechanism 47.

Figure 2A:
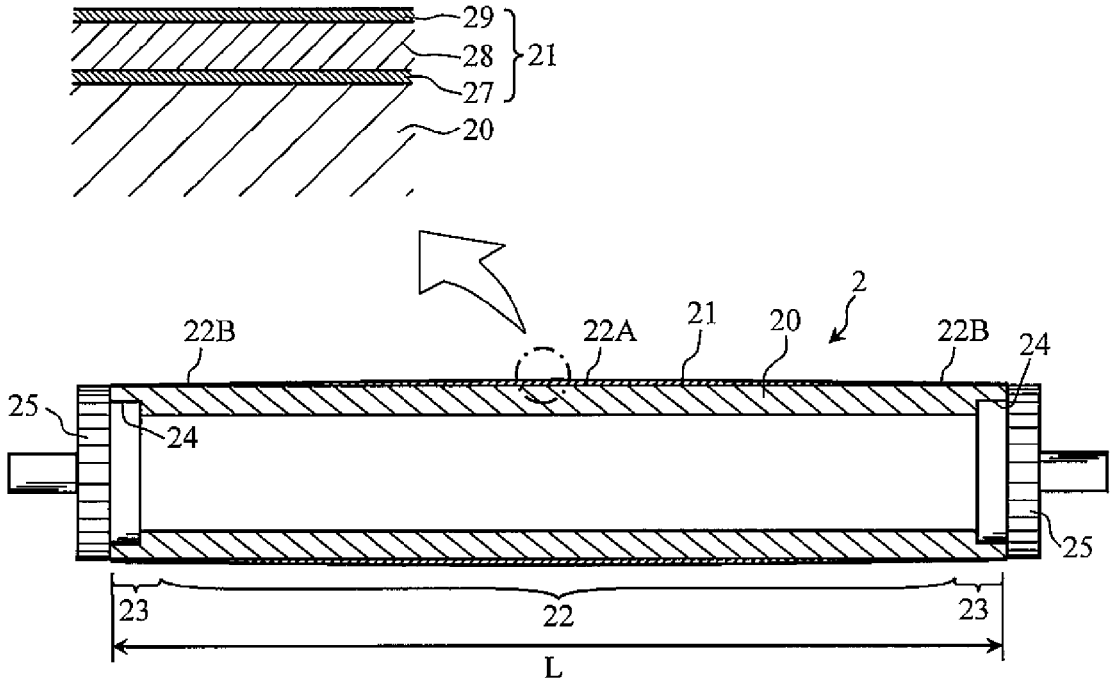
FIG. 2A is a sectional view and an enlarged view of principal portions, illustrating an electrophotographic photosensitive member according to the present invention.
Figure 2B:
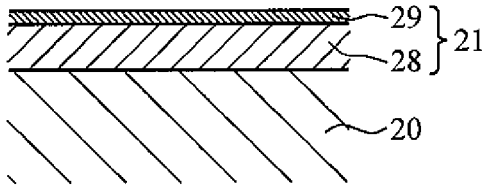
FIG. 2B is an enlarged sectional view illustrating the principal portions of another example of the electrophotographic photosensitive member.

The electrophotographic photosensitive member 2 forms an electrostatic latent image or a toner image according to an image signal, and can be rotated in the direction of an arrow A in FIG. 1. As shown in FIGS. 2A and 2B, the electrophotographic photosensitive member 2 includes a cylindrical body 20 having a circumference on which a photosensitive layer 21 is formed.

The cylindrical body 20 forms the skeleton of the electrophotographic photosensitive member 2 and holds the electrostatic latent image on its outer circumference. The axis of the cylindrical body 20 has a length L slightly longer than the maximum length of a recording medium P such as a recording paper to be used. Specifically, the length L of the axis is set so that the cylindrical body 20 extends beyond the ends of the recording medium P by not less than 0.5 cm and not more than 5 cm. Thus, the photosensitive layer 21 includes a latent image forming area 22 corresponding to the maximum length of the recording medium P, and non-latent image forming areas 23 provided at the ends of the cylindrical body 20, next to the latent image forming area 22. The non-latent image forming areas 23 are the areas of the photosensitive layer 21 (at the outside of the latent image forming area 22 in the axial direction) which are never to be used in forming a latent image of any size on the photosensitive layer 21.

The cylindrical body 20 is provided with inside low portions 24. Each of the inside low portions 24 is a portion to which a flange 25 is fitted. The flange 25 rotatably supports the electrophotographic photosensitive member 2 and transmits the rotation power from a non-illustrated rotation mechanism to the electrophotographic photosensitive member 2. The illustrated inside low portions 24 are arranged within areas corresponding to the non-latent image forming areas 23, though may extend to an area corresponding to the latent image forming area 22.

The cylindrical body 20 is conductive at least on its surface. Specifically, the cylindrical body 20 may be made of a conductive material as a whole, or may be made of an insulating material having a conductive film formed thereon. The conductive material for forming the cylindrical body 20 may include metal such as Al or SUS (stainless), Zn, Cu, Fe, Ti, Ni, Cr, Ta, Sn, Au, and Ag, and an alloy of these metals, for example. The insulating material for forming the cylindrical body 20 may include resin, glass, and ceramic. The material for forming the conductive film may include a transparent conductive material such as ITO (Indium Tin Oxide) and $SnO_2$, other than the above-described metals. The transparent conductive material can be deposited on the surface of the insulating cylindrical body, utilizing a conventional method such as vapor deposition. Preferably, the cylindrical body 20 is formed of Al alloy material as a whole. In this way, the electrophotographic photosensitive member 2 having a light weight can be made at a low cost, and further, the adhesion of the cylindrical body 20 to an anti-charge injection layer 27 and a photoconductive layer 28, both to be described below, of the photosensitive layer 21 is reliably enhanced when forming the layers 27, 28 by amorphous silicon (a-Si) material.

The photosensitive layer 21 shown in FIG. 2A includes the anti-charge injection layer 27, a photoconductive layer 28 and a surface layer 29 laminated together. In the latent image forming area 22 of the photosensitive layer 21, the thickness and dynamic indentation hardness are larger at a middle portion 22A in the axial direction than at end portions 22B.

In the photosensitive layer 21, a ratio of dynamic indentation hardness at the middle portion 22A to dynamic indentation hardness at the end portions 22B is, for example, not less than 1.03 to 1 and not more than 1.25 to 1. The dynamic indentation hardness at the middle portion 22A of the photosensitive layer 21 is set to, for example, not less than 500 and not more than 1500, while the dynamic indentation hardness at the end portions 22B of the photosensitive layer 21 is set to, for example, not less than 485 and not more than 1456. Further, a difference between the dynamic indentation hardness of the photosensitive layer 21 at the middle portion 22A and at the end portions 22B is not less than 25 and not more than 170, for example.

Here, the dynamic indentation hardness of the photosensitive layer 21 indicates a value measured by a dynamic indentation hardness method. Such dynamic indentation hardness can be obtained by measuring a piece of the electrophotographic photosensitive member 2 cut into a size of 10 mm×20 mm, utilizing "Dynamic Ultra Micro Hardness Tester—201" (manufactured by SHIMADZU CORPORATION). In using this tester a 150° triangular pyramid is used as an indenter, and measurement conditions are set to have indention depth of 100 nm, load range of 19.6 mN, load rate of 0.284393 mN, and holding time of 5 seconds.

The anti-charge injection layer 27 serves to prevent injection of electrons and electron holes from the cylindrical body 20 into the photoconductive layer 28, and various types of anti-charge injection layer 27 may be used depending on the material of the photoconductive layer 28. The anti-charge injection layer 27 may be made of an inorganic material, for example, and if using a-Si material for the photoconductive layer 28, the anti-charge injection layer 27 may also be made of an inorganic material such as a-Si material. In this way, an electrophotographic property with enhanced adhesiveness between the cylindrical body 20 and the photoconductive layer 28 can be obtained.

In forming the anti-charge injection layer 27 using a-Si material, the material may contain a thirteenth group element of the periodic system (hereinafter referred to as "thirteenth group element") or a fifteenth group element of the periodic system (hereinafter referred to as "fifteenth group element") in an amount larger than those contained in the photoconductive layer 28 of a-Si material so as to determine the conductivity type. Further, a large amount of boron (B), nitrogen (N), or oxygen (O) may be also contained so as to have high resistivity.

Note that the anti-charge injection layer 27 is optional and is not always necessary, and as shown in FIG. 2B, the photosensitive layer 21 may include only the photoconductive layer 28 and the surface layer 29. The anti-charge injection layer 27 may be replaced with a long-wavelength light absorbing layer. The long-wavelength light absorbing layer prevents a long-wavelength light (light of a wavelength of not less than 0.8 μm) entering on exposure from reflecting on the surface of the cylindrical body 20, and thus prevents a fringe pattern generated at a formed image.

In the photoconductive layer 28, electrons are excited by a laser irradiation from the exposure mechanism 42, and a carrier, of free electrons or electron holes is generated. The photoconductive layer 28 is formed of a-Si material, amorphous selenium material such as a-Se, Se—Te, and As2Se3, or a chemical compound of a twelfth group element and a sixteenth group element of the periodic system such as ZnO, CdS, and CdSe, for example. As the a-Si material, a-Si, a-SiC, a-SiN, a-SiO, a-SiGe, a-SiCN, a-SiNO, a-SiCO or a-SiCNO may be used. Especially when the photoconductive layer 28 is made of a-Si, or an a-Si alloy material of a-Si and an element such as C, N, and O, it is able to have high luminous sensitivity, high-speed responsiveness, stable repeatability, high heat resistance, and high endurance thereby reliably obtaining an enhanced electrophotographic property. In addition, by forming the surface layer 29 using a-SiC:H, conformity of the photoconductive layer 28 with the surface layer 29 is enhanced. The photoconductive layer 28 may be also formed by changing the above-described inorganic material into particles, and by dispersing the particles in a resin, or may be formed as an OPC photoconductive layer.

In forming the photoconductive layer 28 using an inorganic material as a whole, it can be formed by conventional film formation methods such as a glow discharge decomposition method, various sputtering methods, various vapor deposition methods an ECR method a photo-induced CVD method, a catalyst CVD method, and reactive vapor deposition method, for example. In film forming of the photoconductive layer 28, hydrogen (H) or a halogen element (F, Cl) may be contained in the film by not less than one atom % and not more than 40 atom % for dangling-bond termination. Further, in forming the photoconductive layer 28, for obtaining a desired property such as an electrical property including e.g. dark conductivity and photoconductivity as well as optical bandgap in respective layers, not less than 0.1 ppm and not more than 20000 ppm of a thirteenth group element or a fifteenth group element, or not less than 0.01 ppm and not more than 100 ppm of an element such as C, N, and 0 may be contained.

As the thirteenth group element and the fifteenth group element, in view of high covalence and sensitive change of semiconductor property, as well as of high luminous sensitivity, it is desired to use boron (B) and phosphorus (P). When the thirteenth group element and the fifteenth group element are contained in combination with elements such as C, N, and O, preferably, the thirteenth group element may be contained by not less than 0.1 ppm and not more than 20000 ppm, while the fifteenth group element may be contained by not less than 0.1 ppm and not more than 10000 ppm.

When the photoconductive layer 28 contains none or only a small amount (not less than 0.01 ppm and not more than 100 ppm) of the elements such as C, N, and O, preferably, the thirteenth group element may be contained by not less than 0.1 ppm and not more than 200 ppm, while the fifteenth group element may be contained by not less than 0.01 ppm and not more than 100 ppm. These elements may be contained in a manner that concentration gradient is generated in the thickness direction of the layers, if the average content of the elements in the layers is within the above-described range.

In forming the photoconductive layer 28 using a-Si material, μc-Si (microcrystal silicon) maybe contained, which enhances dark conductivity and photoconductivity, and thus advantageously increases design freedom of the photoconductive layer 28. Such μ-Si can be formed by utilizing a method similar to the above-described method, and by changing the film forming condition. For example, when utilizing a glow discharge decomposition method, the layer can be formed by setting temperature and high-frequency electricity at the cylindrical body 20 higher than in the case using only a-Si, and by increasing flow amount of hydrogen as diluent gas. Further, impurity elements similar to the above-described elements may be added when pt-Si is contained.

The thickness of the photoconductive layer 28 may be determined according to a photoconductive material and a desired electrophotographic property, but it is preferable to be constant in the axial direction. Here, when the thickness of the photoconductive layer 28 is constant, a ratio of the thickness at the middle portion 22A to the thickness at the end portions 22B of the latent image forming area 22 is not more than ±2.5%. When forming the photoconductive layer 28 using a-Si material, the thickness is set to be not less than 5.15 μm and not more than 125 μm.

The thickness of the photoconductive layer 28 may be larger at the middle portion 22A than at the end portions 22B of the latent image forming area 22. In this case, it is preferable that the thickness of the photoconductive layer 28 becomes larger gradually or stepwise, as proceeding from the end portions 22B to the middle portion 22A. Here, when the axial length of the cylindrical body 20 is L, each of the end portions 22B in the latent image forming area 22 is spaced from an end of the photosensitive layer 21 by not less than 0.1 L and not more than 0.25 L in the axial direction of the cylindrical body 20.

Here, the thickness of the photoconductive layer 28 at each of the middle portion 22A and the end portions 22B in the latent image forming area 22 is an average value of thickness measured at any five points along the circumference of each portion. However, in measuring the thickness, particular portions with defective film or broken film are not measured. The thickness of the photoconductive layer 28 is calculated by optical interferometry. Specifically, light at not less than 1000 nm and not more than 1100 nm is entered into the target portions to obtain a light transmission curve, so that the thickness is calculated based on the maximum and minimum of the transmission curve and on the refractive index at the surface layer (reference document: page 42-46 of "Measurement and Evaluation of Thin Layer Material" issued by TECHNICAL INFORMATION INSTITUTE CO., LTD).

Figure 3:
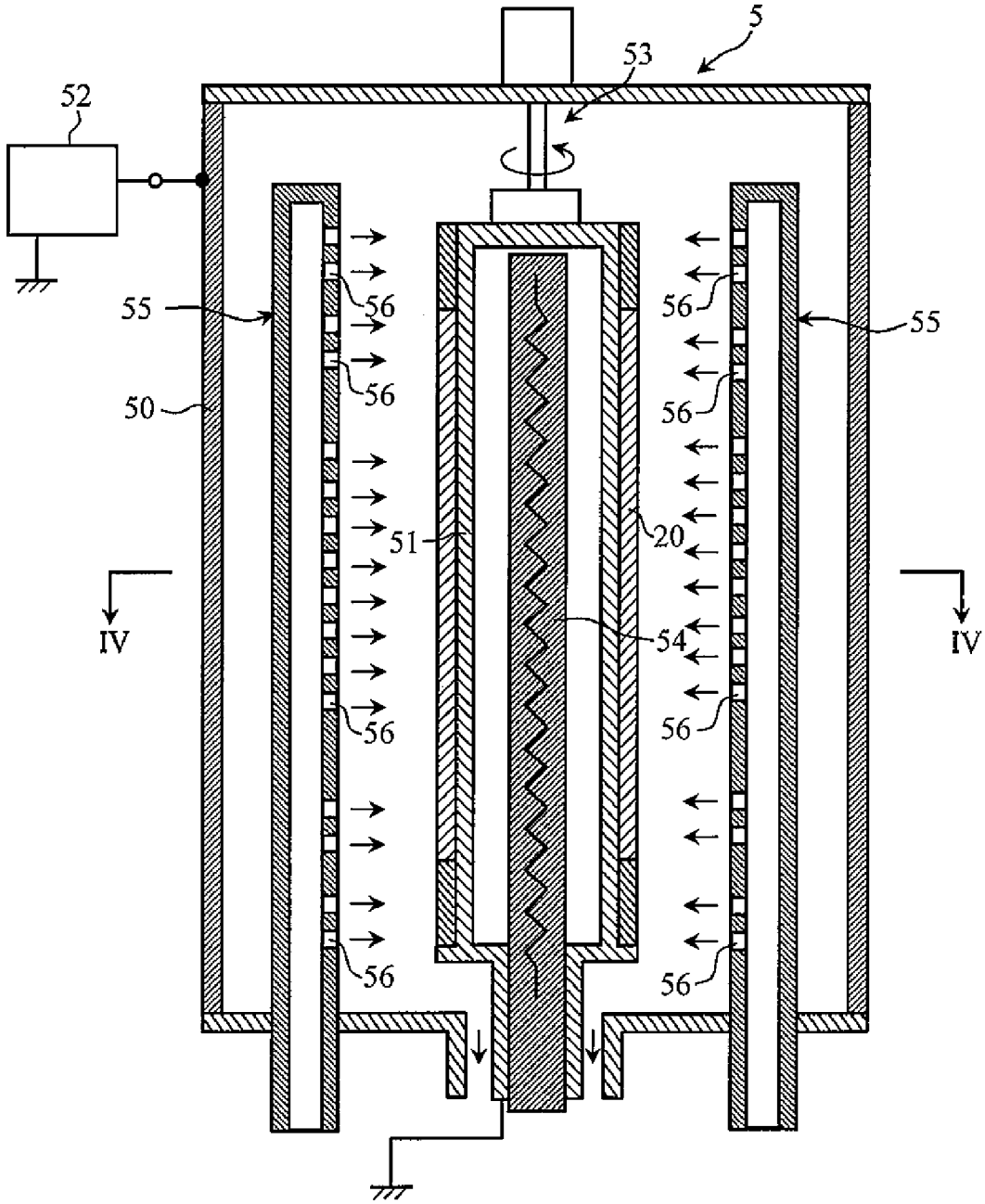
FIG. 3 is a sectional view illustrating an example of a glow discharge decomposition device for manufacturing the electrophotographic photosensitive member shown in FIGS. 2A and 2B.
Figure 4:
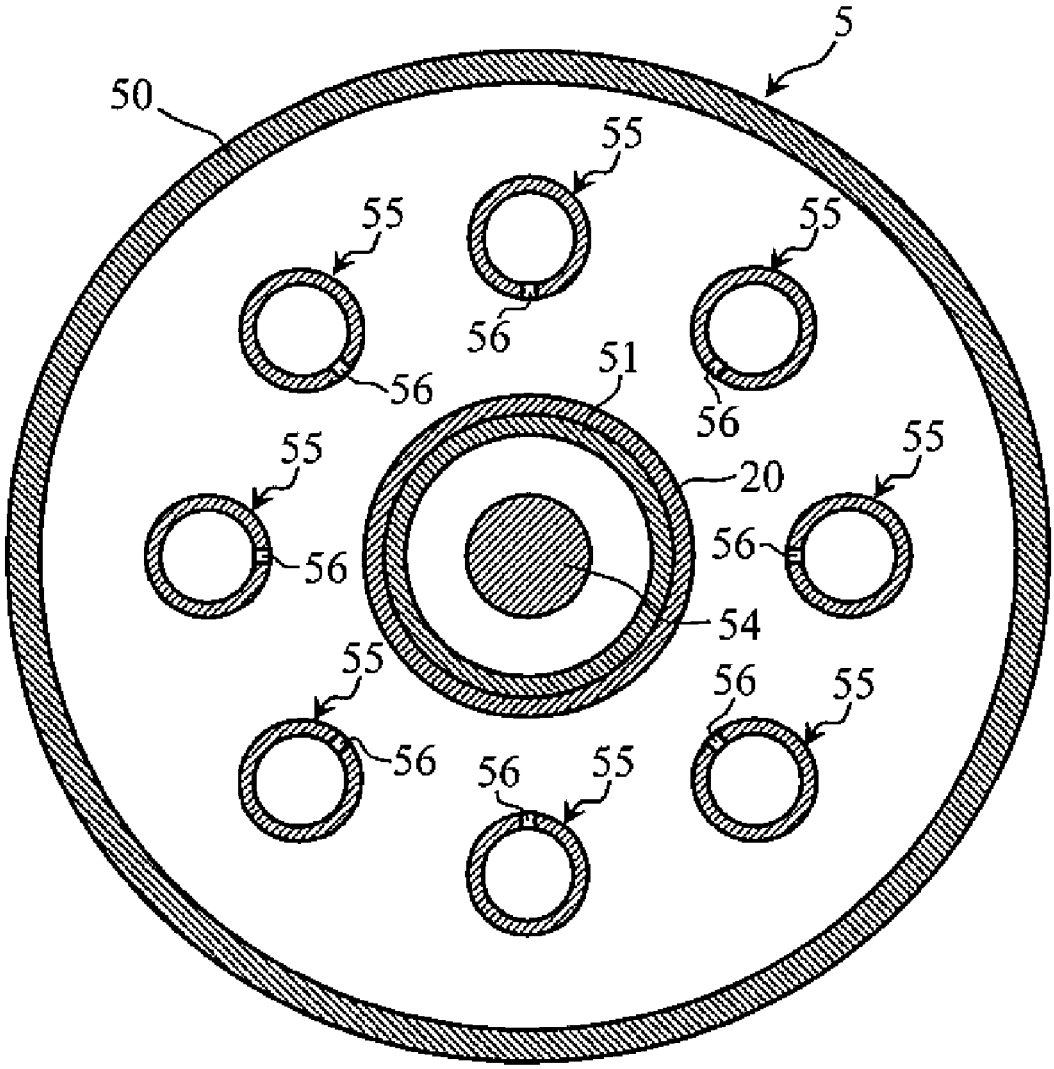
FIG. 4 is a sectional view taken along lines IV-IV of FIG. 3.

The photoconductive layer 28 can be formed by a glow discharge decomposition device 5 shown in FIGS. 3 and 4, for example. The illustrated glow discharge decomposition device 5 includes a cylindrical vacuum container 50 having an intermediate portion provided with a supporting member 51 for supporting the cylindrical body 20. By glow discharge plasma, a-Si film is formed on the cylindrical body 20. In the glow discharge decomposition device 5, the supporting member 51 is grounded and the vacuum container 50 is connected to a high-frequency power source 52 for applying high-frequency power between the vacuum container 50 and the supporting member 51 (cylindrical body 20). The supporting member 51 can be rotated by a rotating mechanism 53, and heated by a heater 54 provided therein. The glow discharge decomposition device 5 further includes a plurality (eight in the figure) of gas inlet tubes 55 surrounding the supporting member 51 (cylindrical body 20). Each of the gas inlet tubes 55 is provided with a plurality of gas inlet ports 56 aligned in the axial direction. The gas inlet ports 56 of the gas inlet tube 55 are positioned to face the cylindrical body 20, so that material gas introduced through the gas inlet ports 56 is blew out toward the cylindrical body 20.

In forming the a-Si film on the cylindrical body 20 using the glow discharge decomposition device 5, material gas of predetermined amount and gas ratio is introduced into the cylindrical body 20 through the gas inlet ports 56 of the gas inlet tubes 55. Here, the cylindrical body 20 together with the supporting member 51 is rotated by the rotating mechanism 53. The high-frequency power source 52 applies high-frequency power between the vacuum container 50 and the supporting member 51 (cylindrical body 20), and glow discharge is performed to decompose the material gas, so that the a-Si film is formed on the cylindrical body 20 which is set at a desired temperature.

Figure 5:
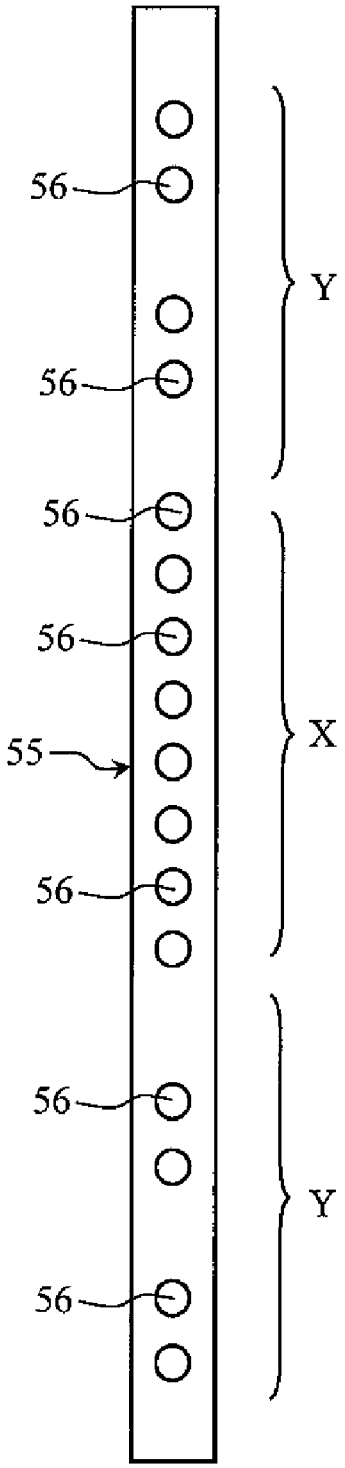
FIG. 5 is a front view illustrating an example of gas inlet tubes of the glow discharge decomposition device shown in FIGS. 3 and 4.

In using such a glow discharge decomposition device 5, by arranging the gas inlet ports 56 of each of the gas inlet tubes 55 at suitable intervals, the thickness of the photoconductive layer 28 may be constant, or may have a thickness larger at the middle portion 22A than at the end portions 22B. For example, when making the thickness at the middle portion 22A larger than at the end portions 22B, as shown in FIG. 5, in an area X corresponding to the area of the photoconductive layer 28 including the middle portion 22A, the gas inlet tubes 56 are arranged at intervals shorter than those in areas Y corresponding to the areas including the end portions 22B. A ratio of intervals in the area X to intervals in the area Y may be set according to the thickness of the photoconductive layer 28 or to the ratio of the thickness at the middle portion 22A to the thickness at the end portions 22B, and may be set to not less than 1.06 to 1 and not more than 2.25 to 1, for example.

Figure 6:
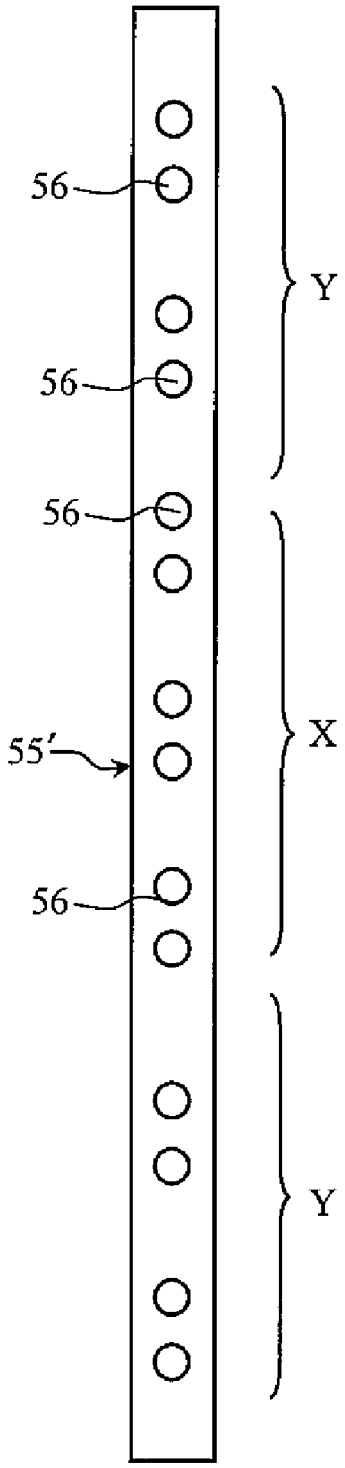
FIG. 6 is a front view illustrating another example of gas inlet tubes of the glow discharge decomposition device shown in FIGS. 3 and 4.

Further, by providing temperature distribution in the axial direction of the cylindrical body 20 using the heater 54, the thickness of the photoconductive layer 28 can be larger at the middle portion 22A than at the end portions 22B. Specifically, by setting the temperature of the cylindrical body 20 higher in the area corresponding to the middle portion 22A than the temperature in the area corresponding to the end portions 22B, the thickness at the middle portion 22A can be larger than at the end portions 22B. In this case, normally a gas inlet tube 55' shown in FIG. 6 is used. The gas inlet tube 55' is provide with gas inlet ports 56 arranged substantially at the same intervals in the area X corresponding to the area of the photoconductive layer 28 including the middle portion 22A, and in the areas Y corresponding to the areas including the end portions 22B.

When making the thickness of the photoconductive layer 28 constant in the axial direction, the gas inlet tube 55' shown in FIG. 6 is used, and the temperature of the cylindrical body 20 is set to be constant in the axial direction.

The surface layer 29 shown in FIG. 2 for protecting the photoconductive layer 28 from friction and wear is laminated on the surface of the photoconductive layer 28. The surface layer 29 is formed of an inorganic material represented by a-Si material such as a-SiC, and has a thickness of not less than 0.2 μm and not more than 1.5 μm at the middle portion 22A of the latent image forming area 22. By making the surface layer 29 to have a thickness of not less than 0.2 μm, flaw in image and variation in density due to wear can be prevented, and by making the surface layer 29 to have a thickness of not more than 1.5 μm, initial characterization (such as defective image due to residual potential) can be improved. Preferably, the thickness of the surface layer 29 may be not less than 0.5 μm and not more than 1.0 μm.

In the surface layer 29, the thickness is larger at the middle portion 22A than at the end portions 22B. The ratio of thickness of the surface layer 29 at the middle portion 22A to the one at the end portions 22B may be set to not less than 1.03 to 1 and not more than 1.25 to 1. The difference between the thickness at the middle portion 22A and at the end portions 22B is set to not less than 0.03 μm to not more than 0.21 μm, preferably not less than 0.09 μm and not more than 0.14 μm.

The thickness of the surface layer 29 at the middle portion 22A and the end portions 22B is defined similarly to the thickness of the photoconductive layer 28, and is similarly calculated by optical interferometry. However, the wavelength of light used for measuring the thickness of the surface layer 29 is at not less than 400 nm and not more than 700 nm.

In the surface layer 29, the dynamic indentation hardness is higher at the middle portion 22A than at the end portions 22B. The dynamic indentation hardness of the surface layer 29 gradually becomes higher as proceeding from the end portions 22B toward the middle portion 22A, or becomes higher stepwise as proceeding from the end portions 22B toward the middle portion 22A.

Such surface layer 29 is formed of a-Si material for example, and especially, it is preferable to use amorphous hydrogenated silicon carbide expressed as the following chemical formula 1. In this way, the electrophotographic photosensitive member 2 can have e.g. high endurance based on high electrical property, high luminous sensitivity, high image property, and high hardness.

$$a\text{-}Si_{1-X}C_X{:}H$$

$$0.65 \leqq X \leqq 0.92 \qquad \text{Formula 1}$$

In Formula 1, the value X (carbon atom ratio) is set to $0.65 \leqq X \leqq 0.92$, for example, preferably to $0.7 \leqq X \leqq 0.85$. By setting the value X within the above range, a proper hardness for the surface layer 29 can be obtained, thereby obtaining high endurance. On the other hand, by setting the value X to less than 0.65, the surface layer 29 is too hard, which causes difficulty in complete removal of toner and discharge products, while by setting the value X to more than 0.92, the surface layer 29 is too soft, in which the surface is likely to be damaged.

In forming the surface layer 29 using a-SiC:H, hydrogen content is preferably set to about 1-70 atom %. Especially when the H content is lowered within the above range, Si—H binding is lowered, and carrier trap generated by light irradiation on the surface of the surface layer 29 can be controlled, thereby suitably preventing residual potential. In view of this, in forming the surface layer 29 using a-SiC:H, it is preferable to set hydrogen content to not more than about 45 atom %.

The surface layer 29 of a-SiC:H can be formed, similarly to the formation of the photoconductive layer 28 using a-Si material, utilizing the glow discharge decomposition device 5 shown in FIGS. 3 and 4. In this case, to make the thickness of the surface layer 29 at the, middle portion 22A to be larger than at the end portions 22B, material gas may include Si-containing gas such as silane gas ($SiH_4$), C-containing gas such as methane gas ($CH_4$), and if necessary, diluent gas such as $H_2$ gas, and the gas inlet tubes 55 illustrated in FIG. 5 may be used similarly to the formation of the photoconductive layer 28 with a large thickness at the middle portion 22A. Further, the thickness of the surface layer 29 at the middle portion 22A can also be made larger than at the end portions 22B, by setting the temperature of the cylindrical body 20 to be higher at an area corresponding to the middle portion 22A than at an area corresponding to the end portions 22B.

In using the gas inlet tubes 55 shown in FIG. 5 to make the thickness at the middle portion 22A larger than the thickness at the end portions 22B, conditions are set as follows, for example: The gas ratio of $CH_4$ and $SiH_4$ is not less than 10 to 1 and not more than 300 to 1; The dilution rate using $H_2$ gas is not less than 0% and not more than 50%; The gas pressure for film forming is about not less than 0.15 Torr and not more than 0.65 Torr; The high-frequency electricity is about not less than 100 W and not more than 350 W per one cylindrical body 20; The temperature of the cylindrical body 20 is not less than 200° and not more than 300°; The high-frequency electricity is applied under frequency of 13.56 MHz, or under frequency of 13.56 MHz with pulse-modulation at 1 kHz.

Further, in forming the surface layer 29 using amorphous hydrogenated silicon carbide, the hardness of the surface layer 29 may be set to become gradually lower as proceeding from a boundary surface with the photoconductive layer 28 to a free surface. Specifically, in composition of the surface layer 29, the value X is set to become gradually greater as proceeding from the boundary surface with the photoconductive layer 28 to the free surface, so that the hardness of the surface layer 29 becomes gradually lower as proceeding from the boundary surface to the free surface. In the electrophotographic photosensitive member 2 provided with such surface layer 29, at the beginning of use of the electrophotographic photosensitive member 2, discharge products getting into fine recesses existing on the surface of the surface layer 29 can be removed by smoothing the recesses. Meanwhile, as undergoing printing processes, the hardness of the surface layer 29 becomes higher, and thus less cut by grinding, thereby preventing the surface from being damaged. As a result, in the electrophotographic photosensitive member 2 provided with such a surface layer 29 an enhanced electrophotographic property can be maintained for long periods.

The surface layer 29 in which the value X becomes greater as proceeding from the boundary surface with the photoconductive layer 28 to the free surface, may be formed by a glow discharge decomposition method, for example. In forming the surface layer 29, as proceeding from the boundary surface with the photoconductive layer 28 to the free surface of the surface layer 29, conditions are changed in any one of the following ways: a ratio of gas containing C to gas containing Si in the material gas gradually becomes higher; the dilution rate of hydrogen gas in the material gas gradually becomes lower the discharging voltage gradually becomes lower; the temperature of the cylindrical body 20 gradually becomes lower; or a combination of the above-described ways.

The electrification mechanism 41 shown in FIG. 1 uniformly charges the surface of the electrophotographic photosensitive member 2, positively and negatively at about a range of not less than 200V and not more than 1000V, according to the type of the photoconductive layer 28 of the electrophotographic photosensitive member 2. The electrification mechanism 41 is arranged in pressing contact with the electrophotographic photosensitive member 2, and is made by coating a cored bar with conductive rubber and PYDF (polyvinylidene fluoride). The electrification mechanism 41 may be a roller provided with a discharging wire.

The exposure mechanism 42 serves to form an electrostatic latent image on the electrophotographic photosensitive member 2, and is capable of emitting light of a predetermined wavelength (not less than 650 nm and not more than 780 nm, for example). The exposure mechanism 42 forms an electrostatic latent image which is an electric potential contrast by emitting light on the surface of the electrophotographic photosensitive member 2 according to an image signal, and lowering the electrical potential at the emitted portion. An example of the exposure mechanism 42 includes a LED head in which LED elements capable of emitting light at a wavelength of e.g. about 680 nm are arranged.

Of course, the exposure mechanism 42 maybe capable of emitting laser light. By replacing the exposure mechanism 42 having the LED head with an optical system using e.g. laser light or a polygon mirror or with an optical system using e.g. a lens or a mirror through which light reflected at paper is transmitted, the image forming apparatus may have a function of a copying apparatus.

The development mechanism 43 forms a toner image by developing the electrostatic latent image formed on the electrophotographic photosensitive member 2. The development mechanism 43 includes a magnetic roller 43A for magnetically holding developer (toner), and a wheel (not shown) or a so-called skid for adjusting a gap from the electrophotographic photosensitive member 2.

The developer serves to develop a toner image formed on the surface of the electrophotographic photosensitive member 2, and is frictionally charged at the development mechanism 43. The developer may be a binary developer of magnetic carrier and insulating toner, or a one-component developer of magnetic toner.

The magnetic roller 43A serves to transfer the developer to the surface (developing area) of the electrophotographic photosensitive member 2.

In the development mechanism 43, the toner frictionally charged by the magnetic roller 43A is transferred in a form of magnetic brush with bristles each having a predetermined length. On the developing area of the electrophotographic photosensitive member 2, the toner is caused to stick to the surface of the photosensitive member 2 by electrostatic attraction between the toner and the electrostatic latent image, and becomes visible. When the toner image is formed by regular developing, the toner image is charged in the reverse polarity of the polarity of the surface of the electrophotographic photosensitive member 2. On the other hand, when the toner image is formed by reverse developing, the toner image is charged in the same polarity as the polarity of the surface of the electrophotographic photosensitive member 2.

Though the development mechanism 43 utilizes a dry developing method, a wet developing method using liquid developer may be utilized.

The transfer mechanism 44 transfers the toner image on the electrophotographic photosensitive member 2 onto a recording medium P supplied to a transfer area between the electrophotographic photosensitive member 2 and the transfer mechanism 44. The transfer mechanism 44 includes a transfer charger 44A and a separation charger 44B. In the transfer mechanism 44, the rear side (non-recording surface) of the recording medium P is charged in the reverse polarity of the toner image by the transfer charger 44A, and by the electrostatic attraction between this electrification charge and the toner image, the toner image is transferred on the recording medium P. Further, in the transfer mechanism 44, simultaneously with the transfer of the toner image, the rear side of the recording medium P is charged in alternating polarity by the separation charger 44B, so that the recording medium P is quickly separated from the surface of the electrophotographic photosensitive member 2.

As the transfer mechanism 44, a transfer roller driven with the rotation of the electrophotographic photosensitive member 2, and being spaced from the electrophotographic photosensitive member 2 by a minute gap (generally, not more than 0.5 mm) may be used. The transfer roller applies a transfer voltage to the recording medium P, using e.g. direct-current power source, for attracting the toner image on the electrophotographic photosensitive member 2 onto the recording medium P. In using the transfer roller, a separation member such as the separation charger 44B is omitted.

The fixing mechanism 45 serves to fix a toner image, which is transferred on the recording medium P, onto the recording medium P, and includes a pair of fixing rollers 45A, 45B. Each of the fixing rollers 45A, 45B is, for example, a metal roller coated by Teflon (registered trademark). In the fixing mechanism 45, the recording medium P passes through between the fixing rollers 45A, 45B, so that the toner image is fixed on the recording medium P by heat or pressure.

The cleaning mechanism 46 shown in FIGS. 1 and 2 serves to remove the toner remaining on the surface of the electrophotographic photosensitive member 2, and includes a cleaning blade 46A.

The cleaning blade 46A serves to scrape the remaining toner off the surface of the surface layer 29 of the electrophotographic photosensitive member 2. The cleaning blade 46A is supported by a case 46C via urging means such as springs 46B, so that its tip end presses the latent image forming area 22 of the electrophotographic photosensitive member 2. The cleaning blade 46A is made of a rubber material mainly containing polyurethane resin, for example, and has a thickness of not less than 1.0 mm and not more than 1.2 mm at its tip portion in contact with the surface layer 29 (see FIG. 2), a linear pressure of 14 gf/cm (generally not less than 5 gf/cm and not more than 30 gf/cm), and a JIS hardness of 74 degrees (preferably not less than 67 degrees and not more than 84 degrees).

The discharging mechanism 47 removes surface charge on the electrophotographic photosensitive member 2. The discharging mechanism 47 irradiates the whole surface (the surface layer 29) of the electrophotographic photosensitive member 2 by a light source such as a LED, and removes the surface charge (remaining electrostatic latent image) of the electrophotographic photosensitive member 2.

In the electrophotographic photosensitive member 2, the photosensitive layer 21 has a thickness smaller, or a dynamic indentation hardness lower at the end portions 22B than at the middle portion 22A in the axial direction of the latent image forming area 22. Thus, even at the middle portion 22A where the photosensitive layer 21 is ground greater, flaws in images and variation in density in the axial direction after undergoing printing processes can be prevented.

Especially, for making the thickness to become smaller, or the dynamic indentation hardness to become lower as proceeding toward the end portions 22B, a ratio of the thickness at the middle portion 22A to the thickness at the end portions 22B is set to not less than 1.03 to 1 and not more than 1.25 to 1, for example, or a ratio of the dynamic indentation hardness at the middle portion 22A to that at the end portions 22B is set to not less than 1.03 to 1 and not more than 1.25 to 1. In this way, variation in density at the beginning of printing as well as flaws in images and variation in density after undergoing printing processes can be prevented.

Further, in the electrophotographic photosensitive member 2, since the surface layer 29 has a thickness larger, or a dynamic indentation hardness higher at the middle portion 22A than at the end portions 22B in the axial direction, even if a foreign object such as dust is caught between the electrophotographic photosensitive member 2 and pressing members (such as the cleaning blade 46A) pressing the outer circumference of the electrophotographic photosensitive member 2, the middle portion 22A of the photoconductive layer 28 formed under the surface layer 29 is unlikely to be damaged. In other words, a crack is unlikely to be caused even when a foreign object such as dust is caught between the electrophotographic photosensitive member 2 and the pressing members. Further, even if a crack is caused, since the thickness of the photosensitive layer 21 (the photoconductive layer 28 and the surface layer 29) is larger at the middle portion 22A than at the end portions 22B, or the dynamic indentation hardness is higher at the middle portion 22A than at the end portions 22B, the crack caused at the middle portion 22A is prevented from extending to the photoconductive layer 28 and to the cylindrical body 20. In this way, the structure prevents damage of the photoconductive layer 28, electrical short circuit between the photoconductive layer 28 and the surface layer 29, and charge leakage to the cylindrical body 20. As a result, the photosensitive layer 21 (photoconductive layer 28) is unlikely to be functionally broken, and thus the image forming apparatus 1 is prevented from forming a defective image and stands long use.

Figure 7:
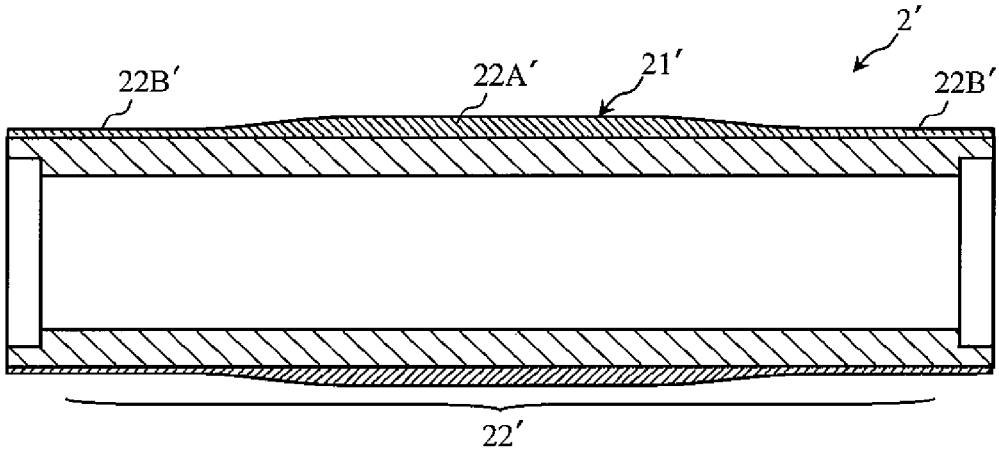
FIG. 7 is a sectional view illustrating another example of the electrophotographic photosensitive member according to the present invention.

As shown in FIG. 7, an electrophotographic photosensitive member 2' may be used, in which a thickness of a photosensitive layer 21' at a latent image forming area 22' is not limited to be gradually becoming larger, but may become larger stepwise from end portions 22B' to a middle portion 22A'. In the example shown in FIG. 7, only one step is formed between the middle portion 22A' and each of the end portions 22B', however, more than two steps may be formed.

Figure 8:
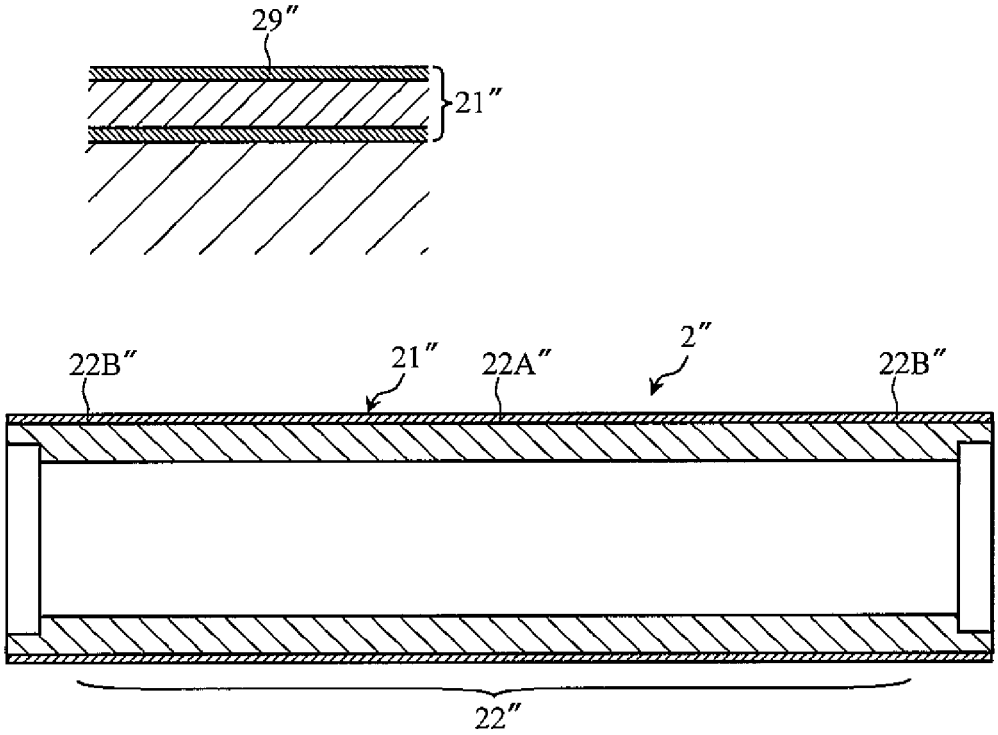
FIG. 8 is a sectional view illustrating another example of the electrophotographic photosensitive member according to the present invention.

Further, as shown in FIG. 8, an electrophotographic photosensitive member 2" may be used, which includes a photosensitive layer 21" having a thickness constant at a middle portion 22A" and end portions 22B" of a latent image forming area 22". The photosensitive layer 21" has a dynamic indentation hardness larger at the middle portion 22A" than at the end portions 22B". When forming the surface layer 29" by a material mainly containing a-SiC, carbon content at the middle portion 22A" and at the end portions 22B" is controlled, so that the dynamic indentation hardness of the photosensitive layer 21" is larger at the middle portion 22A" than at the end portions 22B". Specifically, when comparing a ratio of Si:C in the surface layer 29" at the middle portion 22A" to that at the end portions 22B", it suffices if the C content, which is within a range of not less than 20% to not more than 70%, is higher at the middle portion 22A" than at the end portions 22B".

Next, examples of the electrophotographic photosensitive member 2 according to the present invention are described. However, the present invention is not limited to the following examples, and may be variously changed or modified without a departure from the subject of the present invention.

Example 1

In the present example, the electrophotographic photosensitive member 2 shown in FIG. 2A was manufactured (as a photosensitive member 1-1), and measurement of thickness and composition of the surface layer, as well as evaluation of image property after undergoing printing processes were performed. As a comparative example, an electrophotographic photosensitive member having a surface layer with a thickness substantially constant in the axial direction was manufactured (as a photosensitive member 1-2), and measurement of thickness and composition of the surface layer, as well as evaluation of image property after undergoing printing processes were performed.

(Manufacture of Photosensitive Member)

In manufacturing the electrophotographic photosensitive member 1-1, a cylindrical body 20 was prepared by making a drawn tube of aluminum alloy with an outer diameter of 30 mm and a length of 254 mm, and then performing mirror finishing on the outer circumference of the drawn tube before cleaning. Next, the prepared cylindrical body was incorporated in the glow discharge decomposition device 5 shown in FIGS. 3 and 4, and an anti-charge injection layer 27, a photoconductive layer 28, and a surface layer 29 were laminated in this order under film forming conditions shown in the following Tables 1 and 2. Table 2 shows film forming conditions at a boundary surface between the surface layer 29 and the photoconductive layer 28 as well as film forming conditions at a free surface of the surface layer 29. Film forming between the boundary surface and the free surface was performed by gradually changing the gas flow amount and the film forming speed.

The photosensitive member 1-2 was manufactured similarly to the photosensitive member 1-1 as shown in Tables 1 and 2, however, as can be seen from Table 2, the surface layer was formed under the same film forming conditions at the boundary surface with the photoconductive layer and at the free surface.

TABLE 1

| Layer | | Anti-charge Injection Layer | Photoconductive Layer |
|---|---|---|---|
| Gas Flow Amount | $SiH_4$ (sccm) | 133 | 300 |
| | $B_2H_6$* | 0.16% | 0.7 ppm |
| | NO* | 10.00% | — |
| Gas Pressure (Pa) | | 57 | 60 |
| Board Temperature (° C.) | | 280 | 280 |
| RF Electric Power (W) | | 133 | 300 |

TABLE 1-continued

| Layer | Anti-charge Injection Layer | Photoconductive Layer |
|---|---|---|
| Film Forming Time (Hr) | 1 | 3 |
| Thickness at Middle Portion (μm) | 2.5 | 15 |

*proportion to the amount of $SiH_4$

TABLE 2

| Layer | | Photosensitive Member 1-1 | | Photosensitive Member 1-2 | |
|---|---|---|---|---|---|
| | | Boundary Surface | Free Surface | Boundary Surface | Free Surface |
| Gas Flow Amount | $SiH_4$ (sccm) | 8.3 | 2.78 | 50 | 50 |
| | $CH_4$ (sccm) | 167 | 167 | 100 | 100 |
| | $H_2$ (sccm) | 100 (36.3%) | 100 (37.1%) | 200 (57.1%) | 200 (57.1%) |
| Gas Pressure (Pa) | | 46.6 | 46.6 | 46.6 | 46.6 |
| Board Temperature (° C.) | | 280 | 280 | 280 | 280 |
| RF Electric Power (W) | | 150 | 150 | 80 | 80 |
| Film Forming Time (Hr) | | 2.5 | | 1.5 | |
| Thickness at Middle Portion (μm) | | 0.85 | | 0.85 | |

Numbers in parentheses indicate dilution rates.

(Measurement of Thickness and Composition of Surface Layer)

The thickness of each of the surface layers of the photosensitive members 1-1, 1-2 was measured at a middle portion and at end portions (portions apart from the ends of the image forming area other than the non-image forming area by 25 mm) in the axial direction, utilizing an optical thickness measuring apparatus. The composition of the surface layer (value X in the formula a-$Si_{1-x}C_x$:H) was measured at the middle portion and the end portions of the surface layer in the axial direction, by cutting out a 5 mm cube at each portion and performing XPS (X-ray photoelectron spectrometry). The measurement results of the thickness and value X at the free surface are shown in Table 3.

TABLE 3

| | Photosensitive Member 1-1 | | | Photosensitive Member 1-2 | | |
|---|---|---|---|---|---|---|
| | Middle Portion | Upper End | Lower End | Middle Portion | Upper End | Lower End |
| Thickness of Surface Layer (μm) | 0.85 | 0.77 (0.91) | 0.79 (0.93) | 0.85 | 0.83 (0.98) | 0.86 (1.01) |
| Value X at Free Surface | 0.84 | 0.80 | 0.81 | 0.45 | 0.44 | 0.46 |

Numbers in parentheses indicate ratio to the thickness at the middle portion.

(Evaluation of Image Property)

The photosensitive members 1-1, 1-2 were incorporated in an electrophotographic printer (Model: FS-1550 manufactured by Kyocera Corporation) for printing 300 thousand copies. The image property was evaluated by visually checking flaws and variation in density of printed images at stages of printing processes. The evaluation results are shown in Table 4.

In Table 4, the evaluation results were respectively indicated as "○" when neither flaw nor variation in density was found, as "Δ" when a slight flaw or variation in density was found, and as "×" when any flaw or variation in density which may cause a practical problem was found.

TABLE 4

| Evaluation Item | | Photosensitive Member | | | |
|---|---|---|---|---|---|
| | | Photosensitive Member 1-1 | | Photosensitive Member 1-2 | |
| | | Flaw | Variation in Density | Flaw | Variation in Density |
| Number of Printing | Beginning | ○ | ○ | ○ | ○ |
| | 5,000 | ○ | ○ | ○ | ○ |
| | 10,000 | ○ | ○ | ○ | ○ |
| | 50,000 | ○ | ○ | ○ | Δ |
| | 100,000 | ○ | ○ | ○ | x |
| | 300,000 | ○ | ○ | ○ | x |

As can be seen from Table 4, in the conventional photosensitive member 1-2 having a surface layer with a substantially constant thickness, image degradation was found after printing more than 50,000 copies. On the other hand, in the photosensitive member 1-1 having a surface layer with a thickness smaller at the end portions than at the middle portion, neither flaw nor variation in density was found, and images of good quality were consistently obtained. For a small electrophotographic photosensitive member such as the photosensitive members 1-1, 1-2, it suffices if usable until printing 300,000 copies. Thus, the photosensitive member 1-1 according to the present invention was proved to have adequate endurance for practical use.

Further, in the present example, measurement of the thickness and composition (value X) of the surface layer was performed after undergoing printing processes. The results are shown in Table 5.

TABLE 5

| | Photosensitive Member 1-1 | | | Photosensitive Member 1-2 | | |
|---|---|---|---|---|---|---|
| | Middle Portion | Upper End | Lower End | Middle Portion | Upper End | Lower End |
| Thickness of Surface Layer (μm) | 0.65 | 0.65 | 0.67 | 0.66 | 0.73 | 0.76 |
| Value X at Free Surface | 0.72 | 0.70 | 0.71 | 0.37 | 0.42 | 0.43 |

As can be seen from Table 5, in the photosensitive member 1-1, a difference between the thickness of the surface layer at the middle portion and at the end portions after printing 300,000 copies was 100 Å on average. On the other hand, in the photosensitive member 1-2, a difference between the thicknesses at the middle portion and the at the end portions was 1200 Å on average. From the results, it can be seen that, in the photosensitive member 1-1 according to the present invention, the difference between the thicknesses at the middle portion and at the end portions is set to be small after undergoing printing processes, and thus variation in density is prevented.

Variation in density at the beginning due to a slight variation in thickness of the surface layer in the axial direction (i.e. the thickness gradually becoming smaller as proceeding from the middle portion to the end portions) can be prevented, by adjusting the arrangement in the image forming apparatus (e.g. the electrification mechanism and optical system). However, it is difficult to perform the adjustment for the variation in thickness of the surface layer in the axial direction during printing processes. Therefore, it is important that the variation in thickness of the surface layer in the axial direction does not become greater than at the beginning.

Example 2

In the present example, measurement of thickness of the surface layer and evaluation of image property were performed when changing RF electric power in forming the surface layer.

Photosensitive members 2-1 through 2-13 were manufactured basically in the same way as Example 1, and measurement of thickness of the surface layer and evaluation of image property (at the beginning and after printing 300,000 copies) were performed also in the same way as Example 1. However, RF electric power in forming each of the surface layers was set as shown in Table 6. Measurement results of thickness of the surface layer and evaluation results of image property are shown in Table 6 together with the RF electric power.

TABLE 6

| Photo-sensitive Member | RF Electric Power [W] | Thickness of Surface Layer [μm] | | | Image Property | |
|---|---|---|---|---|---|---|
| | | Middle Portion | Upper End | Lower End | Flaw | Variation in Density |
| 2-1 | 10 | 0.85 | 0.84 | 0.84 | ○ | x (fogged at middle portion) |
| 2-2 | 30 | 0.85 | 0.84 | 0.84 | ○ | x (fogged at middle portion) |
| 2-3 | 50 | 0.85 | 0.83 | 0.84 | ○ | x (fogged at middle portion) |
| 2-4 | 75 | 0.85 | 0.83 | 0.83 | ○ | Δ (fogged at middle portion) |
| 2-5 | 100 | 0.85 | 0.81 | 0.82 | ○ | ○ |
| 2-6 | 150 | 0.85 | 0.77 | 0.79 | ○ | ○ |
| 2-7 | 200 | 0.85 | 0.72 | 0.73 | ○ | ○ |
| 2-8 | 250 | 0.85 | 0.67 | 0.68 | ○ | ○ |
| 2-9 | 300 | 0.85 | 0.63 | 0.65 | ○ | ○ |
| 2-10 | 350 | 0.85 | 0.60 | 0.61 | ○ | ○ |
| 2-11 | 400 | 0.85 | 0.58 | 0.59 | ○ | Δ (at the beginning) |
| 2-12 | 500 | 0.85 | 0.55 | 0.55 | Δ | Δ (at the beginning) |
| 2-13 | 600 | 0.85 | 0.53 | 0.53 | Δ | Δ (at the beginning) |

As can be seen from Table 6, in the photosensitive members 2-1 through 2-3, variation in density in the axial direction (i.e. having high density at the middle portion in the axial direction) was found after printing 300,000 copies, and in the photosensitive member 2-4, variation in density in the axial direction was occasionally found after printing 300,000 copies. Meanwhile, in the photosensitive members 2-11 through 2-13, variation in density in the axial direction (i.e. having high density at the middle portion in the axial direction) was occasionally found at the beginning.

On the other hand, in the photosensitive members 2-5 through 2-10 each having a surface layer formed under RF electrical power of 100-300 W, neither flaw nor variation in density was found, and images of good quality were consistently obtained. In each of these photosensitive members 2-5 through 2-10, a ratio of the thickness of the surface layer at the end portions to the thickness at the middle portion is not less than 0.7 to 1 and not more than 0.96 to 1. Thus, the present example also proves that, in a photosensitive member having a surface layer in which a ratio of the thickness at the end portions to the thickness at the middle portion is not less than 0.7 to 1 and not more than 0.96 to 1, enhanced image property can be obtained after printing 300,000 copies that is a required level in practical use.

Example 3

In the present example, measurement of thickness of the surface layer and evaluation of image property were performed when changing dilution amount (flow rate) of hydrogen ($H_2$) in forming the surface layer.

Photosensitive members 3-1 through 3-11 were manufactured basically in the same way as Example 1, and measurement of thickness of the surface layer and evaluation of image property (at the beginning and after printing 300,000 copies) were performed also in the same way as Example 1. However, dilution amount (flow rate) of hydrogen ($H_2$) in forming each of the surface layers was set as shown in Table 7. Measurement results of thickness of the surface layer and evaluation results of image property are shown in Table 7 together with the dilution amount (flow rate) of hydrogen ($H_2$).

TABLE 7

| Photosensitive Member | $H_2$ Dilution Rate [%] | Thickness of Surface Layer [μm] Middle Portion | Upper End | Lower End | Image Property Flaw | Variation in Density |
|---|---|---|---|---|---|---|
| 3-1 | 0 | 0.85 | 0.72 | 0.72 | ○ | ○ |
| 3-2 | 5 | 0.85 | 0.72 | 0.73 | ○ | ○ |
| 3-3 | 12 | 0.85 | 0.73 | 0.73 | ○ | ○ |
| 3-4 | 24 | 0.85 | 0.75 | 0.75 | ○ | ○ |
| 3-5 | 36 | 0.85 | 0.77 | 0.79 | ○ | ○ |
| 3-6 | 48 | 0.85 | 0.80 | 0.81 | ○ | ○ |
| 3-7 | 50 | 0.85 | 0.82 | 0.82 | ○ | ○ |
| 3-8 | 52 | 0.85 | 0.83 | 0.83 | ○ | Δ (fogged at middle portion) |
| 3-9 | 55 | 0.85 | 0.84 | 0.85 | ○ | x (fogged at middle portion) |
| 3-10 | 60 | 0.85 | 0.84 | 0.86 | ○ | x (fogged at the middle portion) |
| 3-11 | 70 | 0.85 | 0.84 | 0.87 | ○ | x (fogged at middle portion) |

As can be seen from Table 7, in the photosensitive member 3-8, variation in density in the axial direction was occasionally found in images after printing 300,000 copies, while in the photosensitive members 3-9 through 3-11, variation in density in the axial direction (i.e. having high density at the middle portion of the body) was consistently found in images after 300,000 copies. On the other hand, in the photosensitive members 3-1 through 3-7 each having a surface layer formed with $H_2$ dilution amount of 0% to not more than 50%, neither flaw nor variation in density was found, and images of good quality were consistently obtained. Each of the photosensitive members 3-1 through 3-7 has a surface layer in which a ratio of the thickness at the end portions to the thickness at the middle portion is not more than 0.96 to 1. Thus, the present example proves that, when a ratio of the thickness of the surface layer at the end portions to the thickness at the middle portion is not more than 0.96 to 1, especially enhanced image property can be obtained after printing 300,000 copies that is a required level in practical use.

Example 4

In the present example, measurement of value X (carbon atom ratio) of the surface layer and evaluation of image property were performed when changing flow amount of $SiH_4$ in forming the surface layer.

Photosensitive members 4-1 through 4-11 were manufactured basically in the same way as Example 1, and measurement of value X of the surface layer and evaluation of image property (at the beginning and after printing 300,000 copies) were performed also in the same way as Example 1. However, flow amount of $SiH_4$ in forming each of the surface layers was set as shown in Table 8. Measurement results of value X of the surface layer and evaluation results of image property are shown in Table 8 together with the flow amount of $SiH_4$.

TABLE 8

| Photosensitive Member | $SiH_4$ Flow Amount (sccm) | Value X | Image Property Flaw | Variation in Density |
|---|---|---|---|---|
| 4-1 | 0 | 1.00 | Δ | ○ |
| 4-2 | 0.5 | 0.95 | Δ | ○ |
| 4-3 | 0.7 | 0.93 | Δ | ○ |
| 4-4 | 1.0 | 0.92 | ○ | ○ |
| 4-5 | 1.5 | 0.89 | ○ | ○ |
| 4-6 | 2.8 | 0.84 | ○ | ○ |
| 4-7 | 10 | 0.72 | ○ | ○ |
| 4-8 | 16 | 0.65 | ○ | ○ |
| 4-9 | 20 | 0.62 | ○ | Δ (Black Spots) |
| 4-10 | 30 | 0.51 | ○ | Δ (Black Spots) |
| 4-11 | 80 | 0.45 | ○ | Δ (Black Spots) |

As can be seen from Table 8, in the photosensitive members 4-1 through 4-3, a lot of flaws were found in images (especially at a portion corresponding to the middle portion in the axial direction of the body) after printing 300,000 copies. Meanwhile, in the photosensitive members 4-9 through 4-11, a lot of black spots (in white solid image) were found in images (especially at a portion corresponding to the middle portion in the axial direction of the body) after printing 300,000 copies.

On the other hand, in the photosensitive members 4-4 through 4-8 each having a surface layer formed with $SiH_4$ flow amount of not less than 1.0 sccm to not more than 16 sccm, neither flaw nor variation in density was found, and images of good quality were consistently obtained. Each of the photosensitive members 4-4 through 4-8 has a surface layer in which value X of composition ($a\text{-}Si_{1-X}C_X{:}H$) is not less than 0.65 and not more than 0.92. Thus, the present example proves that, when the value X of composition ($a\text{-}Si_{1-X}C_x{:}H$) in the surface layer is not less than 0.65 and not more than 0.92, especially enhanced image property can be obtained after printing 300,000 copies that is a required level in practical use.

Example 5

In the present example, measurement of thickness of the surface layer and evaluation of image property were performed when changing film forming time of the surface layer.

Photosensitive members 5-1 through 5-11 were manufactured basically in the same way as Example 1, and measurement of thickness of the surface layer and evaluation of image property (at the beginning and after printing 300,000 copies) were performed also in the same way as Example 1. However, film forming time of each of the surface layers was set as shown in Table 9. Measurement results of thickness of the surface layer and evaluation results of image property are shown in Table 9 together with the film forming time.

TABLE 9

| Photo-sensitive Member | Film Forming Time of Surface Layer [hr] | Thickness of Surface Layer at Middle Portion [μm] | Image Property | |
|---|---|---|---|---|
| | | | Flaw | Variation in Density |
| 5-1 | 0 | 0.00 | x | x (fogged image) |
| 5-2 | 0.3 | 0.11 | Δ | ○ |
| 5-3 | 0.6 | 0.20 | ○ | ○ |
| 5-4 | 1.0 | 0.35 | ○ | ○ |
| 5-5 | 2.0 | 0.71 | ○ | ○ |
| 5-6 | 2.5 | 0.85 | ○ | ○ |
| 5-7 | 3.0 | 1.02 | ○ | ○ |
| 5-8 | 3.5 | 1.20 | ○ | ○ |
| 5-9 | 4.5 | 1.50 | ○ | ○ |
| 5-10 | 4.7 | 1.57 | ○ | Δ (faint image) |
| 5-11 | 5.0 | 1.66 | ○ | Δ (faint image) |

As can be seen from Table 9, in the photosensitive member 5-1, flaws were found in images (especially at a portion corresponding to the middle portion in the axial direction of the body) after printing 300,000 copies. Meanwhile, in the photosensitive member 5-2, flaws were occasionally found in images after printing 300,000 copies. Further, in the photosensitive members 5-10 and 5-11, surface potential was not lowered enough due to a high residual potential, and faint images were occasionally caused.

On the other hand, in the photosensitive members 5-3 through 5-9 each having a surface layer formed in not less than 0.6 hour and not more than 4.5 hours, neither flaw nor variation in density was found, and images of good quality were consistently obtained. Each of the photosensitive members 5-3 through 5-9 has a surface layer with a thickness of not less than 0.2 μm and not more than 1.5 μm at the middle portion. Thus, the present example proves that, when the surface layer has a thickness within the above range at the middle portion, especially enhanced image property can be obtained after printing 300,000 copies that is a required level in practical use.

Example 6

In the present example, influence on the image property was studied when changing the thickness of the photoconductive layer.

Photosensitive members 6-1 through 6-5 were manufactured basically in the same way as Example 1, and measurement of thickness of the surface layer and evaluation of image property (at the beginning and after printing 300,000 copies) were performed also in the same way as Example 1. Each of the photosensitive members 6-1 through 6-3 has a photoconductive layer with a thickness smaller at the end portions than at the middle portion. Each of the photosensitive members 6-4 and 6-5 has a photoconductive layer with a thickness substantially the same at the end portions and at the middle portion. Measurement results of thickness of the photoconductive layer and the photosensitive layer as well as evaluation results of image property are shown in Table 10.

TABLE 10

| Photosensitive Member | Thickness of Photoconductive Layer [μm] | | | Thickness of Surface Layer [μm] | | | Image Property (after printing 50,000 copies) | |
|---|---|---|---|---|---|---|---|---|
| | Middle Portion | Upper End | Lower End | Middle Portion | Upper End | Lower End | Flaw | Variation in Density |
| 6-1 | 13.5 | 12.5 | 12.7 | 0.85 | 0.78 | 0.79 | x | ○ |
| 6-2 | 13.5 | 12.9 | 13.0 | 0.86 | 0.78 | 0.79 | Δ | ○ |
| 6-3 | 13.6 | 13.2 | 13.3 | 0.85 | 0.77 | 0.78 | Δ | ○ |
| 6-4 | 13.6 | 13.3 | 13.3 | 0.86 | 0.78 | 0.80 | ○ | ○ |
| 6-5 | 13.5 | 13.4 | 13.4 | 0.85 | 0.78 | 0.78 | ○ | ○ |

6-1: a lot of black spots at end portions
6-2: 5 black spots at end portions
6-3: 2 black spots at end portions As can be seen from Table 10, when the thickness of the photoconductive layer is smaller at the end portions, in the photosensitive member 6-1, a lot of fine black spots were found at the end portions of images, and in the photosensitive members 6-2 and 6-3, a few (2 to 5) fine black spots were found at the end portions of images.

On the other hand, in the photosensitive members 6-4 and 6-5 each having a photoconductive layer with a thickness substantially the same at the end portions and at the middle portion, neither flaw nor variation in density was found, and images of good quality were consistently obtained. Thus, the present example proves that, when the thickness of the surface layer is smaller at the end portions than at the middle portion, it is preferable that the thickness of the photoconductive layer is substantially constant at the end portions and at the middle portion.

Example 7

In the present example, evaluation of image property was performed when changing dynamic indentation hardness of the photosensitive layer.

In manufacturing an electrophotographic photosensitive member 7-1 used in the present example, a cylindrical body 20 was prepared by making a drawn tube of aluminum alloy with an outer diameter of 84 mm and a length of 360 mm, and then performing mirror finishing on the outer circumference of the drawn tube before cleaning. Next, the prepared cylindrical body 20 was incorporated in the glow discharge decomposition device 5 shown in FIGS. 3 and 4, and an anti-charge injection layer 27, a photoconductive layer 28, and a surface layer 29 were laminated in this order under film forming conditions shown in the following Tables 11 and 12. Table 12 shows film forming conditions at a boundary surface between the surface layer 29 and the photoconductive layer 28 as well as film forming conditions at a free surface of the surface layer 29. Film forming between the boundary surface and the free surface was performed by gradually changing the gas flow amount and the film forming speed.

As a comparative example, a photosensitive member 7-2 is manufactured similarly to the photosensitive member 7-1, but the surface layer was formed using the gas inlet tube 55 shown in FIG. 6.

TABLE 11

| Layer | | Anti-charge Injection Layer | Photoconductive Layer |
|---|---|---|---|
| Gas Flow Amount | $SiH_4$ (sccm) | 133 | 300 |
| | $B_2H_6$* | 0.12% | 2.0 ppm |
| | NO* | 10.40% | — |
| Gas Pressure (Pa) | | 60 | 70.5 |
| Board Temperature (° C.) | | 280 | 280 |
| RF Electric Power (W) | | 146 | 280 |
| Film Forming Time (Hr) | | 1 | 5.5 |
| Thickness at Middle Portion (μm) | | 2.5 | 30 |

*proportion to the amount of $SiH_4$

TABLE 12

| Layer | | Surface Layer | |
|---|---|---|---|
| | | Boundary Surface | Free Surface |
| Gas Flow Amount | $SiH_4$ (sccm) | 24.7 | 8.2 |
| | $CH_4$ (sccm) | 456 | 475 |
| | $H_2$ (sccm) | 650 | 650 |
| Gas Pressure (Pa) | | 86.6 | 86.6 |
| Board Temperature (° C.) | | 280 | 280 |
| RF Electric Power (W) | | 135 | 135 |
| Film Forming Time (Hr) | | 1.0 | 0.5 |
| Thickness at Middle Portion (μm) | | 0.85 | |

(Measurement of Dynamic Indentation Hardness)

The dynamic indentation hardness of each of the photosensitive layers of the photosensitive members 7-1 and 7-2 was measured at the middle portion and the end portions (portions apart from the respective ends of the photosensitive members 7-1 and 7-2 by 40 mm in the axial direction), utilizing a Dynamic Ultra Micro Hardness Tester (Model (Number): DUH-201 manufactured by SHIMADZU CORPORATION). Table 13 shows the measurement results of dynamic indentation hardness of the photosensitive layers. The dynamic indentation hardness was measured at any five points along the circumference of each of the photosensitive members, and the average value is shown in Table 13.

TABLE 13

| Photosensitive Member | Photosensitive Member 7-1 | | Photosensitive Member 7-2 | |
|---|---|---|---|---|
| | Middle Portion | End Portions | Middle Portion | End Portions |
| Hardness of Photosensitive Layer | 825 | 730 | 825 | 820 |

(Evaluation of Image Property)

The photosensitive members 7-1, 7-2 were incorporated in an electrophotographic printer (Model: KM-6030 manufactured by Kyocera Corporation) for printing 300 thousand copies. The image property was evaluated by visually checking flaws and variation in density of printed images at stages of printing processes. The evaluation results are shown in Table 14.

In Table 14, the evaluation results were respectively indicated as "○" when neither flaw nor variation in density was found, as "Δ" when a slight flaw or variation in density was found, and as "×" when any flaw or variation in density which may cause a practical problem was found.

TABLE 14

| Evaluation Item | | Photosensitive Member | | | |
|---|---|---|---|---|---|
| | | Photosensitive Member 7-1 | | Photosensitive Member 7-2 | |
| | | Flaw | Variation in Density | Flaw | Variation in Density |
| Number of Printing | Beginning | ○ | ○ | ○ | ○ |
| | 5,000 | ○ | ○ | ○ | ○ |
| | 10,000 | ○ | ○ | ○ | ○ |
| | 50,000 | ○ | ○ | ○ | ○ |
| | 100,000 | ○ | ○ | x (at middle portion) | x |
| | 300,000 | ○ | ○ | x (at middle portion) | x |

As can be seen from Table 14, in the conventional photosensitive member 7-2 having a surface layer with a substantially constant dynamic indentation hardness, image degradation was found after printing more than 50,000 copies. Further, after printing about 100,000 copies, the middle portion was ground and variation in density was found. As a result, it proved that the conventional photosensitive member would not endure printing further copies.

On the other hand, in the photosensitive member 7-1 according to the present invention having a surface layer with a dynamic indentation hardness smaller at the end portions than at the middle portion, neither flaw nor variation in density was found, and images of good quality were consistently obtained. For a electrophotographic photosensitive member with a size as the photosensitive members 7-1, 7-2, it suffices if usable until printing 300,000 copies. Thus, the photosensitive member 7-1, having a dynamic indentation hardness larger at the middle portion than at the end portions of the latent image forming area, was proved to have adequate endurance for practical use.

Example 8

In the present example, influence on image property was studied when changing a ratio of at the middle portion of the photosensitive layer to the dynamic indentation hardness at the end portions.

Photosensitive members 8-1 through 8-6 were manufactured basically in the same way as Example 7, and measurement of dynamic indentation hardness of the photosensitive layer and evaluation of image property were performed also in the same way as Example 7. The dynamic indentation hardness of the photosensitive layer of each of the photosensitive members 8-1 through 8-6 was adjusted by changing the arrangement of the gas inlet ports of the gas inlet tube to be used. Measurement results of dynamic indentation hardness of the photosensitive layer and evaluation results of image property are shown in Table 15.

TABLE 15

| | Hardness of Photosensitive Layer | | Ratio of Hardness Middle Portion | Image Property | |
|---|---|---|---|---|---|
| Photosensitive Member | Middle Portion | End Portions | to End Portions | Flaw | Variation in Density |
| 8-1 (7-2) | 825 | 820 | 1.01 | x | ○ |
| 8-2 | 830 | 805 | 1.03 | Δ | ○ |
| 8-3 | 820 | 770 | 1.06 | ○ | ○ |
| 8-4 (7-1) | 825 | 730 | 1.13 | ○ | ○ |
| 8-5 | 825 | 660 | 1.25 | ○ | Δ |
| 8-6 | 830 | 650 | 1.28 | ○ | x |

8-1 (7-2): at middle portion

As can be seen from Table 15, in the photosensitive member 8-1 (7-2), flaws in images were found after printing 300,000 copies. In the photosensitive member 8-6, variation in density in the axial direction was found at the beginning.

Meanwhile, in the photosensitive member 8-2, flaws in images were occasionally found after printing 300,000 copies. In the photosensitive member 8-5, variation in density in the axial direction was occasionally found at the beginning. However, the flaws and variation in density found in the photosensitive members 8-2 and 8-5 caused no problem in practical use.

On the other hand, in the photosensitive members 8-3 and 8-4, neither flaw nor variation in density was found, and images of good quality were consistently obtained.

Thus, for obtaining a proper image property, in the photosensitive layer, it is preferable that a ratio of dynamic indentation hardness at the middle portion to that at the end portions is set to be not less than 1.03 and not more than 1.25, more preferably, not less than 1.06 and not more than 1.13.

Example 9

In the present example, influence on image property was studied when changing dynamic indentation hardness of the photosensitive layer at the middle portion.

Photosensitive members 9-1 through 9-6 were manufactured basically in the same way as Example 7, and measurement of dynamic indentation hardness of the photosensitive layer and evaluation of image property were performed also in the same way as Example 7. However, the gas inlet tube for forming each of the photosensitive layers was the same as the one used for forming the photosensitive member 7-1 in Example 7. The dynamic indentation hardness of the photosensitive layer of each of the photosensitive members 9-1 through 9-6 were adjusted by changing the flow amount of $CH_4$ in forming the photosensitive layer (carbon content in the photosensitive layer). Measurement results of dynamic indentation hardness of the photosensitive layer and evaluation results of image property are shown in Table 16.

TABLE 16

| | Hardness of Photosensitive | Image Property | | |
|---|---|---|---|---|
| Photosensitive Member | Layer at Middle Portion | Flaw | Black Spot | Density |
| 9-1 | 450 | x (at middle portion) | ○ | ○ |
| 9-2 | 500 | Δ | ○ | ○ |
| 9-3 | 750 | ○ | ○ | ○ |
| 9-4 | 1000 | ○ | ○ | ○ |
| 9-5 | 1500 | ○ | Δ | Δ |
| 9-6 | 1600 | ○ | x | x |

As can be seen from Table 16, in the photosensitive member 9-1, flaws in images were found at the middle portion after printing about 50,000 copies, which may cause problems in printing further copies. Further, in the photosensitive member 9-6, black spots in images were found at the middle portion and density was lowered after printing about 50,000 copied, which may cause problems in printing further copies.

Meanwhile, in the photosensitive member 9-2, flaws in images were occasionally found after printing 300,000 copies, while in the photosensitive member 9-5, black spots or variation in density in the axial direction was occasionally found at the beginning, however, they caused no problem in practical use.

On the other hand, in the photosensitive members 9-3 and 9-4, neither flaw nor variation in density was found, and images of good quality were consistently obtained.

Thus, for obtaining a proper image property, in the photosensitive layer, it is preferable that dynamic indentation hardness at the middle portion is set to be not less than 500 and not more than 1500, more preferably, not less than 750 and not more than 1000.

The invention claimed is:

1. An electrophotographic photosensitive member rotatably supported in an image forming apparatus, comprising:

a substantially cylindrical body and a photosensitive layer formed thereon and having a latent image forming area, wherein the photosensitive layer is, when incorporated in the image forming apparatus, pressed harder at a middle portion than at end portions in an axial direction of the latent image forming area, and a thickness at the middle portion is larger than at the end portions.

2. The electrophotographic photosensitive member according to claim 1, wherein the thickness of the photosensitive layer gradually becomes smaller as proceeding from the middle portion to the end portions.

3. The electrophotographic photosensitive member according to claim 1, wherein the thickness of the photosensitive layer becomes smaller stepwise as proceeding from the middle portion to the end portions.

4. The electrophotographic photosensitive member according to claim 1, wherein the photosensitive layer includes a photoconductive layer and a surface layer, at least one of the photoconductive layer and the surface layer having a thickness larger at the middle portion than at the end portions.

5. The electrophotographic photosensitive member according to claim 4, wherein the thickness of the surface layer is larger at the middle portion than at the end portions, and the thickness of the photoconductive layer is substantially constant in the axial direction.

6. The electrophotographic photosensitive member according to claim 5, wherein a ratio of the thickness of the surface layer at the end portions to the thickness at the middle portion is not less than 0.70 to 1 and not more than 0.96 to 1.

7. The electrophotographic photosensitive member according to claim 5, wherein the thickness of the surface layer at the middle portion is not less than 0.2 μm and not more than 1.5 μm.

8. The electrophotographic photosensitive member according to claim 4, wherein the surface layer includes amorphous hydrogenated silicon carbide as a main component which is expressed as the following composition formula:

$$a\text{-}Si_{1-X}C_X{:}H$$

$$0.65 \leqq X \leqq 0.92. \qquad \text{Formula 1}$$

9. The electrophotographic photosensitive member according to claim 8, wherein carbon atom ratio X is larger at a free surface of the surface layer than at a boundary surface with the photoconductive layer.

10. The electrophotographic photosensitive member according to claim 9, wherein the carbon atom ratio X gradually becomes larger as proceeding from the boundary surface to the free surface of the surface layer.

11. The electrophotographic photosensitive member according to claim 4, wherein at least one of the photoconductive layer and the surface layer contains an inorganic material.

12. An electrophotographic photosensitive member rotatably supported in an image forming apparatus, comprising:

a substantially cylindrical body and a photosensitive layer formed thereon and having a latent image forming area, wherein the photosensitive layer is, when incorporated in the image forming apparatus, pressed harder at a middle portion than at end portions in an axial direction of the latent image forming area, and a dynamic indentation hardness at the middle portion is larger than at the end portions.

13. The electrophotographic photosensitive member according to claim 12, wherein the dynamic indentation hardness of the photosensitive layer gradually becomes smaller as proceeding from the middle portion to the end portions.

14. The electrophotographic photosensitive member according to claim 12, wherein the dynamic indentation hardness of the photosensitive layer becomes smaller stepwise as proceeding from the middle portion to the end portions.

15. The electrophotographic photosensitive member according to claim 12, wherein a ratio of the dynamic indentation hardness of the photosensitive layer at the middle portion to the dynamic indentation hardness at the end portions is not less than 1.03 to 1 and not more than 1.25 to 1.

16. The electrophotographic photosensitive member according to claim 12, wherein the dynamic indentation hardness of the photosensitive layer at the middle portion is not less than 500 and not more than 1500.

17. The electrophotographic photosensitive member according to claim 12, wherein the dynamic indentation hardness of the photosensitive layer at the end portions is not less than 485 and not more than 1456.

18. The electrophotographic photosensitive member according to claim 12, wherein the photosensitive layer includes a photoconductive layer and a surface layer.

19. The electrophotographic photosensitive member according to claim 18, wherein at least one of the photoconductive layer and the surface layer contains an inorganic material.

20. An image forming apparatus comprising:

the electrophotographic photosensitive member, according to any one of claims 1 through 19, including the substantially cylindrical body which is rotatably supported, and the photosensitive layer formed thereon and having a latent image forming area; and a pressing member pressing the cylindrical body harder at the middle portion than at end portions in the axial direction of the latent image forming area.

21. The image forming apparatus according to claim 20, wherein the pressing member has a pressing portion for pressing the electrophotographic photosensitive member, the pressing portion having a JIS hardness (conform to JIS K6253 A with indenter mass of 180 g and indenter height of 2.5 mm) of not less than 67 degrees and not more than 84 degrees.

* * * * *